US010889985B2

(12) United States Patent
Wang

(10) Patent No.: US 10,889,985 B2
(45) Date of Patent: Jan. 12, 2021

(54) DIVIDER ASSEMBLY

(71) Applicant: Nan Ya Plastics Corporation, Taipei (TW)

(72) Inventor: Kuei-Yung Wang, Taipei (TW)

(73) Assignee: NAN YA PLASTICS CORPORATION

( * ) Notice: Subject to any disclaimer, the term of this patent is extended or adjusted under 35 U.S.C. 154(b) by 0 days.

(21) Appl. No.: 16/893,544

(22) Filed: Jun. 5, 2020

(65) Prior Publication Data

US 2020/0299957 A1 Sep. 24, 2020

(51) Int. Cl.
*E04B 2/74* (2006.01)

(52) U.S. Cl.
CPC .... *E04B 2/7437* (2013.01); *E04B 2002/7446* (2013.01)

(58) Field of Classification Search
CPC ..... E04B 1/34321; E04B 1/34315; E04B 2002/7461; E04B 2002/7437; E04B 2002/7425; E04B 2002/7466; E04B 2002/7479; E04B 2/721; E04B 2/7407; E04B 2/7433; E04B 2/7437; E04B 2/761; E04H 17/168; E04H 17/20
USPC ..... 52/238.1, 239
See application file for complete search history.

(56) References Cited

U.S. PATENT DOCUMENTS 3,509,673 A * 5/1970 Witkosky ..... E04B 1/617 52/242
3,528,559 A * 9/1970 Miller ..... E04B 2/7433 211/195
3,585,768 A * 6/1971 Klein ..... E04B 2/7818 52/282.4
3,782,048 A * 1/1974 Corman ..... E04B 2/744 52/282.2
3,789,567 A * 2/1974 Rae ..... E04B 2/7881 52/584.1
3,859,000 A * 1/1975 Webster ..... B63B 35/34 404/41
4,021,973 A * 5/1977 Hegg ..... A47G 5/00 52/36.6
4,126,978 A * 11/1978 Heller ..... E04B 1/617 52/250
4,142,343 A * 3/1979 Trafton ..... E04C 3/32 248/219.1
4,493,172 A * 1/1985 Jones ..... E04B 2/7845 52/220.1
4,652,170 A * 3/1987 Lew ..... E04B 1/617 403/381
4,676,038 A * 6/1987 Doyon ..... A47B 47/0041 403/231

(Continued)

*Primary Examiner* — Kyle J. Walraed-Sullivan
(74) *Attorney, Agent, or Firm* — Ostrolenk Faber LLP

(57) ABSTRACT

A divider assembly for dividing a space into physically separated sub-spaces, comprising a support structure for fixing a divider in an upstanding orientation thereby dividing said space in which said divider is placed, the support structure includes a body defining a main axis, a holder provided on first side of the main axis and along length of the body for holding the divider in said upstanding orientation, and a coupler provided on second side of the main axis and along length of the body for direct coupling with another said support structure, such that said divider assembly is expandable into adjacent space for creating further separated sub-spaces.

15 Claims, 8 Drawing Sheets

(56) References Cited

U.S. PATENT DOCUMENTS

| | | | | | |
|---|---|---|---|---|---|
| 4,785,565 | A * | 11/1988 | Kuffner | A47F 5/105 | 160/135 |
| 4,852,317 | A * | 8/1989 | Schiavello | E04B 2/7424 | 52/239 |
| 4,968,171 | A * | 11/1990 | Shell | E04B 2/7427 | 16/224 |
| 5,097,643 | A * | 3/1992 | Wittler | E04B 2/7425 | 160/135 |
| 5,363,616 | A * | 11/1994 | Hernandez | A47K 3/36 | 16/355 |
| 5,491,943 | A * | 2/1996 | Vondrejs | E04B 2/7425 | 52/239 |
| 5,737,887 | A * | 4/1998 | Smeenge | E04B 2/7425 | 160/135 |
| 5,864,997 | A * | 2/1999 | Kelly | A01G 9/14 | 52/282.2 |
| 6,052,958 | A * | 4/2000 | Miedema | E04B 2/7437 | 52/239 |
| 6,283,456 | B1 * | 9/2001 | Benz | E04H 17/163 | 160/391 |
| 8,146,317 | B1 * | 4/2012 | Fletcher | E04F 15/02183 | 52/582.2 |
| 8,381,468 | B2 * | 2/2013 | Koupal | E04B 1/6162 | 52/282.1 |
| 8,397,461 | B2 * | 3/2013 | Browning | E04C 2/296 | 52/588.1 |
| 2007/0039259 | A1 * | 2/2007 | MacDonald | E04B 2/7425 | 52/238.1 |
| 2007/0197082 | A1 * | 8/2007 | Zeh | E04B 2/7433 | 439/404 |
| 2018/0128011 | A1 * | 5/2018 | Preston | E04B 1/32 | |
| 2018/0274231 | A1 * | 9/2018 | Epstein | E04B 2/7442 | |

* cited by examiner

DIVIDER ASSEMBLY

The present invention relates to a divider assembly, for example particularly, but not exclusively, a divider assembly for dividing an area of space.

BACKGROUND OF THE INVENTION

Social distancing is currently the new norm. It is against human nature but necessary to avoid spread of diseases. Surgical masks are recommended in public places but may not be mandatory. Some jobs are by nature more exposed to disease as they involve higher exposure to other people. It may not be possible to force others to wear a surgical mask, in particular in places such as restaurants which is a confined area with limited space for eating and drinking. It would not be possible to maintain safe distances between all people when surgical mask is removed. It would not be practical for workers in the restaurant to maintain safe distance from all customers.

Conventional partition assemblies have long been available to form partially isolated spaces which should be useful in acting as barriers against spread of diseases. However, their assembling requires professional support. They are intended for relatively long-term usage and are generally more complex in construction. Couplings between different parts of the assembly usually involve relatively heavy-duty connectors and are intended for long-term if not permanent connection. Disassembling of the partition assembly is simply not intended. The costs for purchasing and assembling the partitions are relatively high and storage of unused partitions would add to the overall costs.

Another problem with conventional partition assemblies is that it does not offer flexibility that allows user to change the configuration of the built assembly according to needs.

The invention seeks to eliminate or at least to mitigate such shortcomings.

SUMMARY OF THE INVENTION

In a first aspect of the invention, there is provided a divider assembly for dividing a space into physically separated sub-spaces, comprising a support structure for fixing a divider in an upstanding orientation thereby dividing said space in which said divider is placed, the support structure includes a body defining a main axis, a holder provided on first side of the main axis and along length of the body for holding the divider in said upstanding orientation, and a coupler provided on second side of the main axis and along length of the body for direct coupling with another said support structure, such that said divider assembly is expandable into adjacent space for creating further separated sub-spaces; Preferably, the holder of the support structure extends in a direction from the body; More preferably, the holder of the support structure includes a groove configured to hold, by friction, said divider in said upstanding orientation; yet more preferably, the holder includes a pair of lips that defines the groove for holding said divider. It is preferable that the holder includes a friction enhancement structure. More preferably, the friction enhancement structure comprises a deformable tongue; preferably, the holder of the support structure elongates lengthwise in a direction parallel to the main axis, and preferably the direction is a radial direction.

Advantageously, the coupler of the support structure extends in a direction from the body; more advantageously, the direction is a radial direction; Yet more advantageously, the coupler of the support structure elongates lengthwise in a direction parallel to the main axis; it is advantageous that the coupler of the support structure includes an abutment surface which is transversely oriented relative to the radial direction; more advantageously, the coupler comprises an arm that extends from the body of the support structure, the arm includes the abutment surface for abutting an arm of said another support structure. Preferably, the abutment surface includes an auxiliary abutment surface that extends transversely to the abutment surface.

Advantageously, the arm has a L-shaped configuration and is integrally formed with the body of the support structure;

In an embodiment, the coupler and the holder of the support structure are structurally identical; preferably, the coupler and the holder include respective grooves configured to hold a divider and to directly couple with a coupler of said another support structure respectively; more preferably, the coupler and the holder each comprises a pair of lips configured to hold a divider and to directly couple with a coupler of said another support structure respectively; yet more preferably, the coupler and the holder each comprises an arm which is integrally formed with and is extended in a direction from the body of the support structure.

Advantageously, the holder and the coupler extend from the body of the support structure and are integrally formed thereto.

It is advantageously that the support structure includes first and second holders provided on first and third sides of the main axis for holding respective dividers in said upstanding orientation, and a coupler provided on a second side of the main axis for direct coupling with said another support structure, wherein an auxiliary holder is provided on the body and between the first and second holders, which when in use assists the holding of said divider; preferably, the first holder is at right angle to the second holder; more preferably, the coupler is provided opposite to the auxiliary holder.

In a second aspect of the invention there is provided a divider assembly for dividing an area into a physically separated sub-space, comprising a first support structure having a body defining a main axis, first and second holders provided on first and third sides of the main axis and along length of the body for holding the divider in said upstanding orientation, and a coupler provided on second side of the main axis and along length of the body for direct coupling with another said support structure, such that said divider assembly is is expandable into adjacent space for creating further separated sub-spaces, a second support structure which is structurally identical to the first support structure, a first divider held by the first holder, a second divider held by the second holder of the first support structure at one end and the first holder of the second support structure at another end, and a third divider held by the second holder of the second support structure to thereby physically delimits and isolates a sub-space in at least three sides from said area.

In a third aspect of the invention there is provided a divider assembly, comprising a first support structure having a body defining a main axis, first and second holders provided on first and third sides of the main axis and along length of the body for holding the divider in said upstanding orientation, and a coupler provided on second side of the main axis and along length of the body for direct coupling with another said support structure, such that said divider assembly is expandable into adjacent space for creating further separated sub-spaces, an auxiliary holder is provided between the first and second holders, a first divider held by the first holder, and a second divider held by the second holder, to thereby define a sub-space in at least two sides and isolate the subspace from said area by the first and second dividers; Preferably, the divider assembly further comprises a second support structure which is structurally identical to the first support structure and is directly coupled to the first support structure by inter-engagement of the couplers on the first and second support structures to form a first support structure assembly, and third and fourth dividers held by the first and second holders of the second support structure respectively, to thereby define four sub-spaces around the main axis, each sub-space is isolated in at least two sides; More preferably, an auxiliary holder is provided between the first and second holder of the first and second support structures respectively; Yet more preferably, the body of the first and second support structures together form two opposite further auxiliary holders positioned between the first holders of the first and second support structures as well as the second holders of the first and second support structures; It is preferable that the divider assembly further comprises third and fourth support structures which are structurally identical to the first and second support structures, the third and fourth support structures are directly coupled to each other by inter-engagement of the couplers on the third and fourth support structures to form a second support structure assembly, the first support structure assembly is arranged on top of the second support structure assembly and the two are in staggered orientation, such that when the auxiliary holder of the first support structure is aligned with the second holder of the third support structure, the auxiliary holder of the second support structure is aligned with the first holder of the fourth support structure; It is more preferable that the first and second support structure assemblies are maintained in staggered orientation by the first divider which spans across the auxiliary holder of the first support structure and the second holder of the third support structure.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1A:
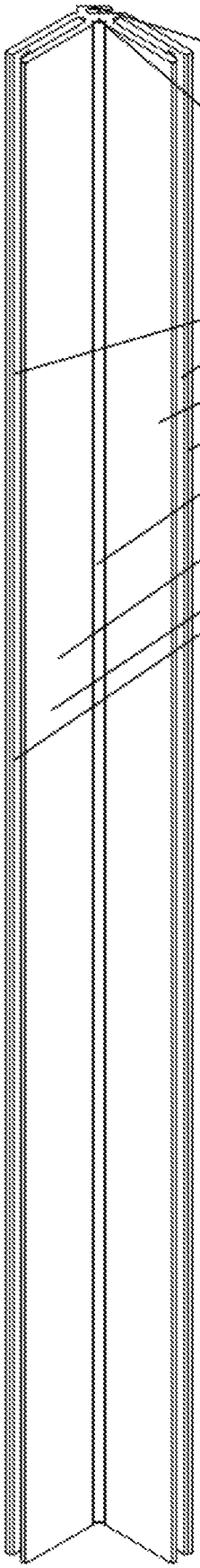
FIG. 1A is an illustrative view of an embodiment of a support structure of a divider assembly according to the invention.

Referring to FIGS. 1 to 8B there is shown a divider assembly 100 in accordance with the invention. The divider assembly 100 has different configurations including but not limited to those as shown in FIGS. 3 to 7E. The divider assembly 100 is intended for easy assembly and disassembly such that a user can readily build and demolish the divider assembly 100 according to needs. More importantly, the divider assembly 100 can be arranged into the different configurations or expanded configuration such as those as shown in FIGS. 3 to 7E by varying the number of component parts to be used and how they connect. These basic components parts includes a support structure 200 as shown in FIG. 1 and a divider as shown in any one of FIGS. 3 to 7E. Arrangement into different configurations or expansion of the divider assembly 100 can be done by changing the number of support structure 200 and corresponding number of dividers 300. Each of the support structures 101 in the different or expanded divider assembly configurations 100 are structurally identical. The same applies to the dividers 300 in FIGS. 3 to 6. However, it is possible for the support structures 101 and the dividers 300 in the same divider assembly 100 to have different dimensions. For example, the dividers 300A to 300H in the fifth configuration of the divider assembly 100 as shown in FIGS. 7A to 7E are four times as big as those in FIGS. 3 to 6.

Figure 1B:
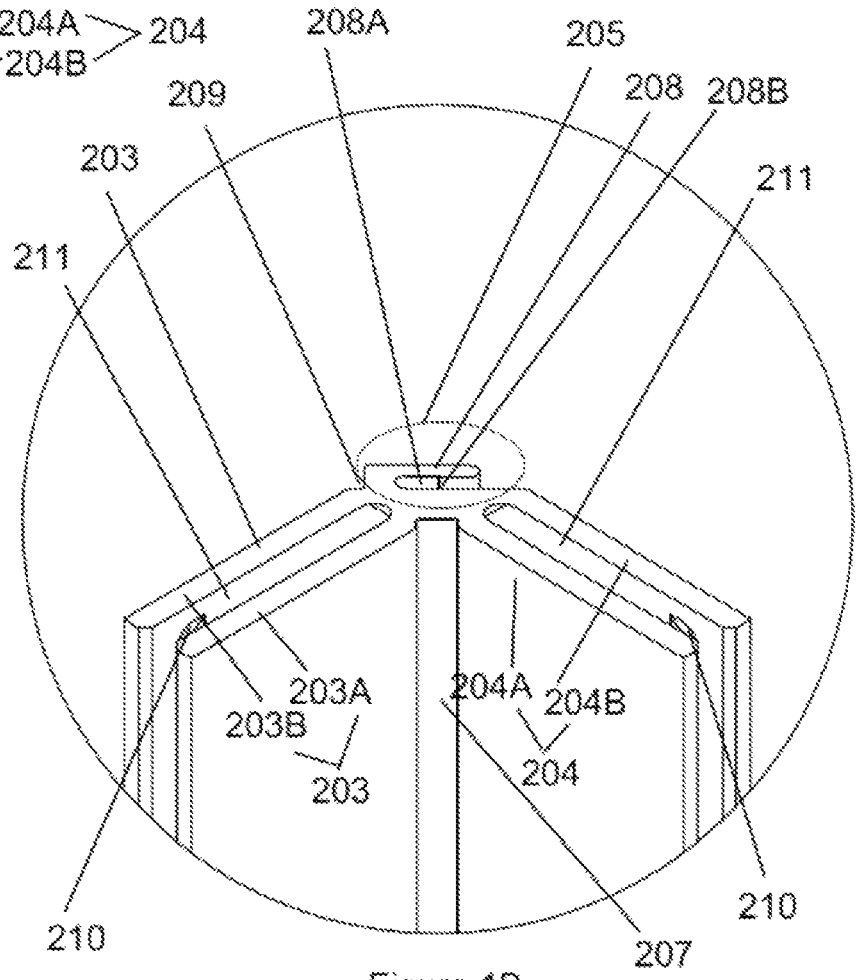
FIG. 1B is an enlarged view of a part of the support structure in FIG. 1A.
Figure 2A:
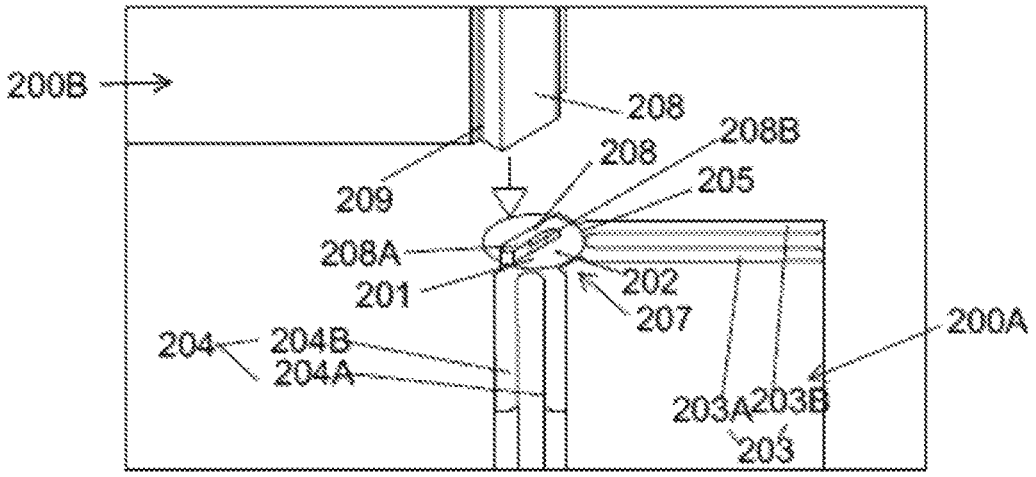
FIG. 2A to 2C are an illustrative sequential drawings showing direct coupling of two support structures in FIG. 1.
Figure 2B:
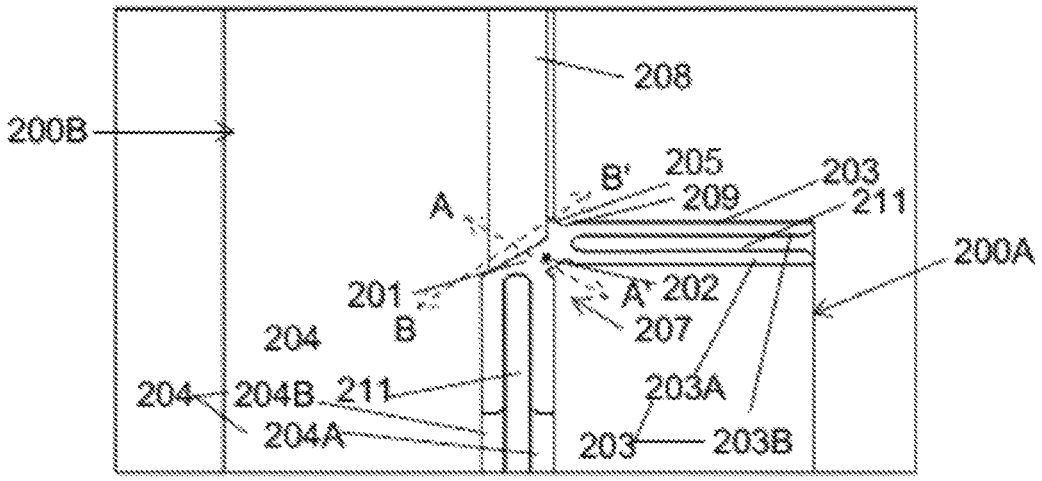
Figure 2C:
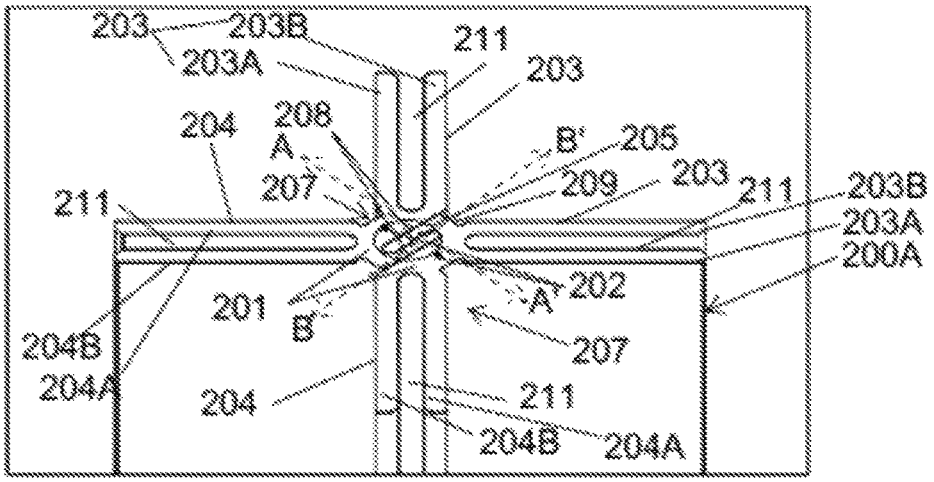

An embodiment of the support structure 101 is shown in FIG. 1, which is useful in fixing the divider 300 in an upstanding orientation and thereby divide the space in which the divider is placed. The support structure includes a body 201 with a main axis 202 that runs along entire length of the body 201. On a first side of the main axis 202 there is provided a first holder 203. On a third side of the main axis 202, there is provided a second holder 204. In this specific embodiment, the first and second holders 203 and 204 forms a right angle between them. These holders 203 and 204 run along length of the body 201 and parallel to the main axis 202 for holding the divider 300 in the upstanding orientation. As can be seen from FIG. 1, the holders 203 and 204 run continuously along entire length of the body 201. A coupler 205 is provided on a second side of the main axis 202. The coupler 205 run along length of the body and parallel to the main axis 202 for direct coupling with another support structure 200 as shown in FIGS. 2A to 2C such that the divider assembly 100 is expandable into adjacent space for creating further separated sub-spaces. An auxiliary holder 207 is provided on the body 201, between the holders 203 and 204 and opposite the coupler 205.

As a possible alternative embodiment, the support structure 200 may include one or more holders 203/204 and such holder 203/204 may run at interval along length of the body 201 or may run along part length of the body 201 at or adjacent two opposite ends of the body 201.

As another possible alternative embodiment, the support structure 200 may include one or more couplers 205 and such coupler 205 may run at interval along length of the body 201 or may run along part length of the body 201 at or adjacent two opposite ends of the body 201.

In more detail, first and second holders 203, 204 extends in different directions from the body 201 and the directions are a radial direction. The holders 203, 204 includes respective grooves 211 configured to hold, by friction, the divider in the upstanding orientation. Each groove 211 includes friction enhancement structure such as a flexible deformable tongue made of plastic or rubber 210 to enhance the frictional engagement between the respective holders 203, 204 and the divider 300. The groove 210 is about 32.1 mm long and 2.1 mm wide. More specifically, each first or second holder 203, 204 includes a pair of lips 203A and 203B, 204A and 204B that delimits the respective grooves 211. Each pair of lips 203A and 203B, 204A and 204B are connected at one end and run substantially parallel to one another such that the first and second holders 203 and, 204 have U-shaped configuration. The connected end of the lips 203A, 203B, 204A, 204B are integrally formed with the body 201 of the support structure 200. As each pair of lips 203A and 203B, 204A and 204B functions as a clip to frictionally hold an edge of the divider 300, these lips 203A and 203B, 204A and 204B may be configured to be slightly converging towards one another or includes friction enhancing features such as the deformable tongue 210 that extends from the lip 203A as shown in FIG. 1B. The lips 203A, 203B, 204A and 204B has a chamfered free end to function as guides for insertion of the divider 300. The thickness of the lip 203A, 203B, 204A or 204B is about 3 mm.

The coupler 205 extends in a direction, more specifically a radial direction from the body 201. It is in the form of an arm 208 in an L-shaped configuration that extends from the body 201 of the support structure 200. The arm 208 includes an abutment surface 208A for abutting the abutment surface 208A of the arm of another support structure 200 such that the two support structures 200 can be in direct coupling as illustrated in FIGS. 2A to 2C. The arm 208 of one support structure 200 is slotted into a space defined between the arm 208 and the periphery of the body 201 of another support structure 200. These arms 208 are held together by way of friction. The arm 208 may be oriented slightly towards the periphery of the body 201 such that it functions as a clip that holds on to the arm 208 of another support structure 200. Friction enhancing features may be introduced to enhance the function of the arm 208. The coupled support structures 200 are locked to one another at least in the directions A and A'. Additional feature on the abutment surface 208A such as an auxiliary abutment surface 208B that is arranged traversely to the abutment surface 208A would be useful in locking the support structures 200 in the direction B and B'. In the embodiment as shown in FIGS. 1 to 2C. The auxiliary abutment surface 208B is in the form of a step on the abutment surface 208A.

In this embodiment, the coupler 205 and the holders 203 and 204 are of different configurations. However it is possible that the coupler 205 and the holders 203 and 204 are of the same configuration as long as their function can be performed.

With reference to FIG. 1B as well as FIGS. 2A to 2C, an auxiliary holder 207 is provided between the first and second holders 203 and 204. It is in the form of an elongated groove extending into the body 201. It is shaped to accommodate an edge of a divider 300. The auxiliary holder 207 may run continuously along length of the body 201 or may run at interval along length of the body 201. It may only run along part length of the body 201 at or adjacent the two opposite ends of the body 201.

In the preferred embodiment, the holders 203, 204, the coupler 205 as well as the auxiliary holder 207 are integrally formed with the body 201 of the support structure 200.

With reference to FIG. 1, when two dividers 300 are held by the holders 203 and 204, the support structure 200 along with the dividers (not shown) divide a space into a sub-space which is isolated from the rest of the space in at least on two sides or dimensions. These dividers (not shown) act as shields against transmission of material out of the sub-space through the two sides. As the dividers are inserted into the groove 210, there is no gap between the support structure 200 and the dividers 300. The intact connection contributes to the function of the dividers 300 as a barrier against transmission of material through them.

As shown in FIGS. 2A to 2C, there are two support structures 200A and 200B. When these support structures 200A and 200B are directly coupled by the couplers 208, four holders 203 and 204 are arranged at right angle to one another. The support structures 200A and 200B are locked into position and is prevented from relative movement in the A-A' and B-B' directions by the collective effect of the abutment surfaces 208A and 208B in each of the couplers 208. Four dividers 300 can be held in upright orientation by respective holders 203 and 204 to divide a space into four sub-spaces. These four sub-spaces are physically separated from one another in at least two sides or dimensions by the dividers (not shown).

A step 209 is provided between the L-shaped coupler 205 and the first holder 203. When the two support structures 200A and 200B are coupled, the step 209 of the first support structure 200 together with a side of the first holder 203 of the second support structure 200 form a further auxiliary holder 207. When the two support structures 200 are coupled, there are two further auxiliary holders 207 in addition to the auxiliary holders 207 provided between each pair of first and second holders 203 and 204. In total, four auxiliary holders 207 are provided at right angle to one another and each auxiliary holder 208 is positioned between respective pairs of holders 203, 204.

The dividers 300 are preferably made of transparent material such as glass or plastic. The support structure are preferably made of aluminum or plastic. All plastic components are preferably made from extrusion.

Figure 3:
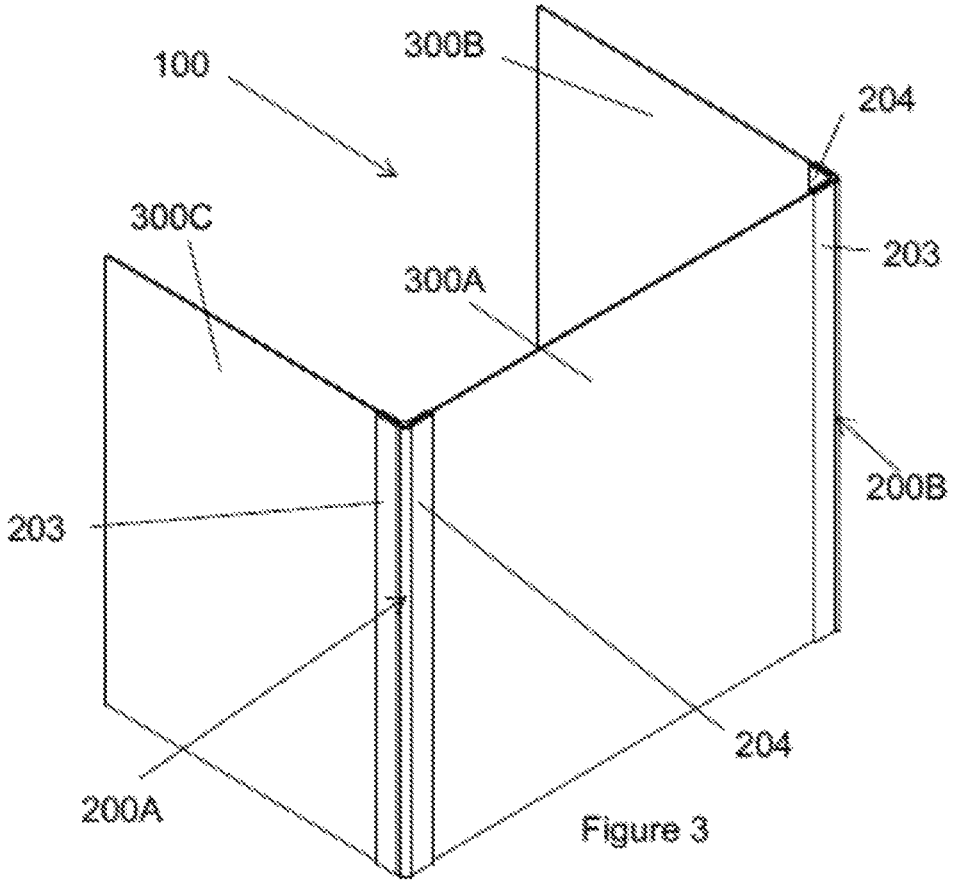
FIG. 3 is an illustrative view of the divider assembly in a first configuration.

FIG. 3 discloses a first configuration of the divider assembly 100. It includes first and second support structures 200A and 200B that are inter-connected by a first divider 300A through respective holders 203 and 204 on these support structures 200A and 200B. The second and third dividers 300B and 300C are fixed to the remaining holder 204 or 203 of the support structures 200B and 200A. In total, there are three dividers 300A, 300B and 300C which collectively delimit, in at least three sides or dimensions, a generally rectangular or square sub-space that is isolated from its surroundings by the dividers 300. These dividers 300 may or may not be of the same dimensions.

Figure 4:
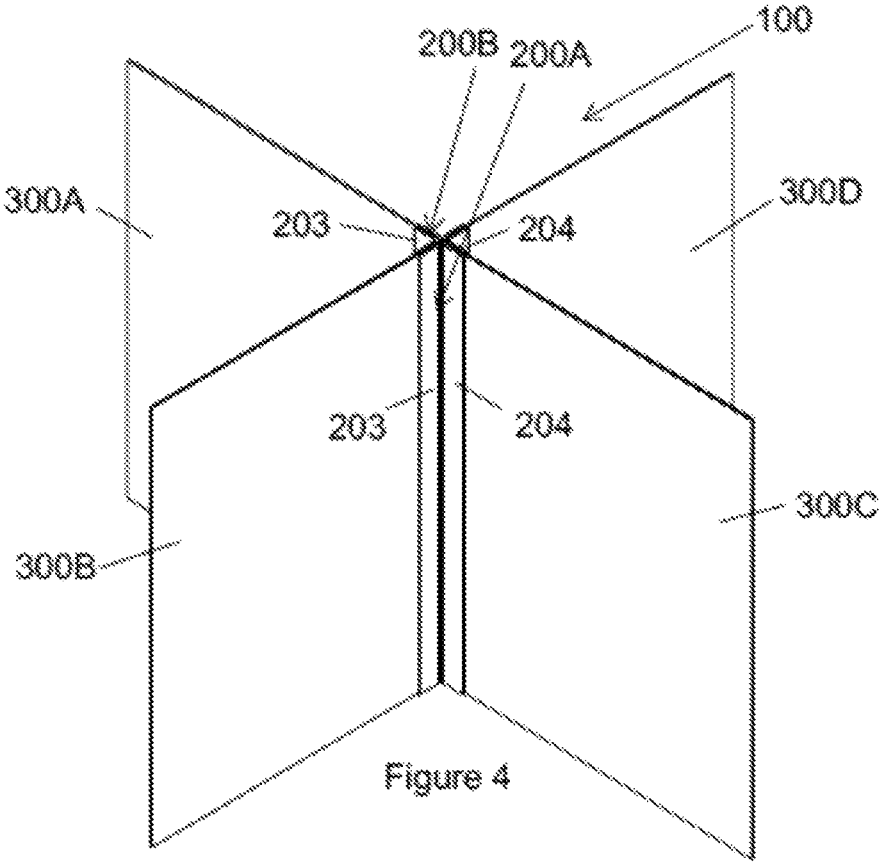
FIG. 4 is an illustrative view of the divider assembly in a second configuration.

In FIG. 4, there is disclosed the second configuration of the divider assembly 100. It includes two support structures 200A and 200B but this time, they are directly coupled to each other through the respective couplers 205. First, second, third and fourth dividers 300A, 300B, 300C and 300D are held by respective holders 203, 204 and 204, 203 of the support structures 200A and 200B at right angle to one another to form four sub-spaces that are isolated from one another at two sides. When placed on a surface such as a round table, the space on the table will instantly be divided into four sub-spaces. This configuration is the same as that in FIGS. 2A to 2C but with the dividers 300 being inserted into the holders 203 and 204.

Figure 5:
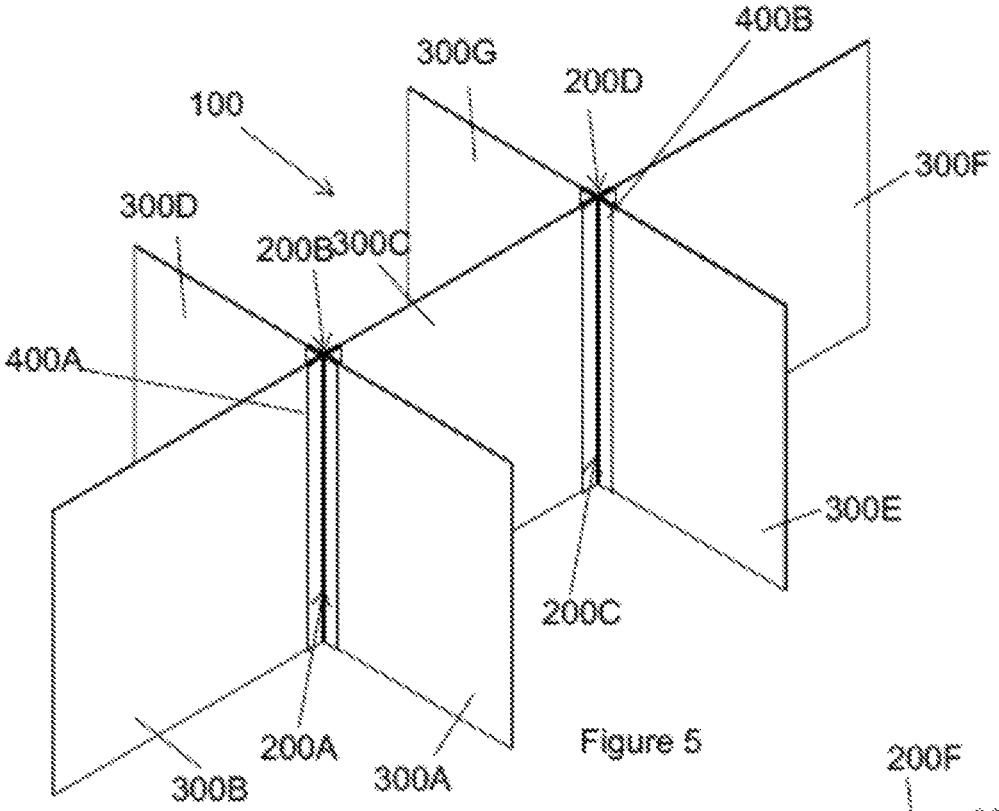
FIG. 5 is an illustrative view of the divider assembly in a third configuration.

A third configuration of the divider assembly 100 is shown in FIGS. 5 5. This configuration includes first, second, third and fourth support structures 200A to 200D and seven dividers 300A to 300G to form six isolated sub-spaces with two of them being isolated at three sides and the remaining four being isolated at two sides. It may be considered to include two units of the embodiment in FIG. 4. The first and second support structures 200A and 200B are coupled directly to form a first support structure assembly 400A. The third and fourth support structures 200C and 200D are coupled directly to form a second support structure assembly 400B. The first and second support structure assemblies 400A and 400B are interconnected by one divider 300A with two opposite ends being held by respective holders 203 and 204 of the first and third support structures 200A and 200C. All dividers 300A to 300G are at right angle to one another. All dividers 300 are shared between sub-spaces for isolation.

Figure 6:
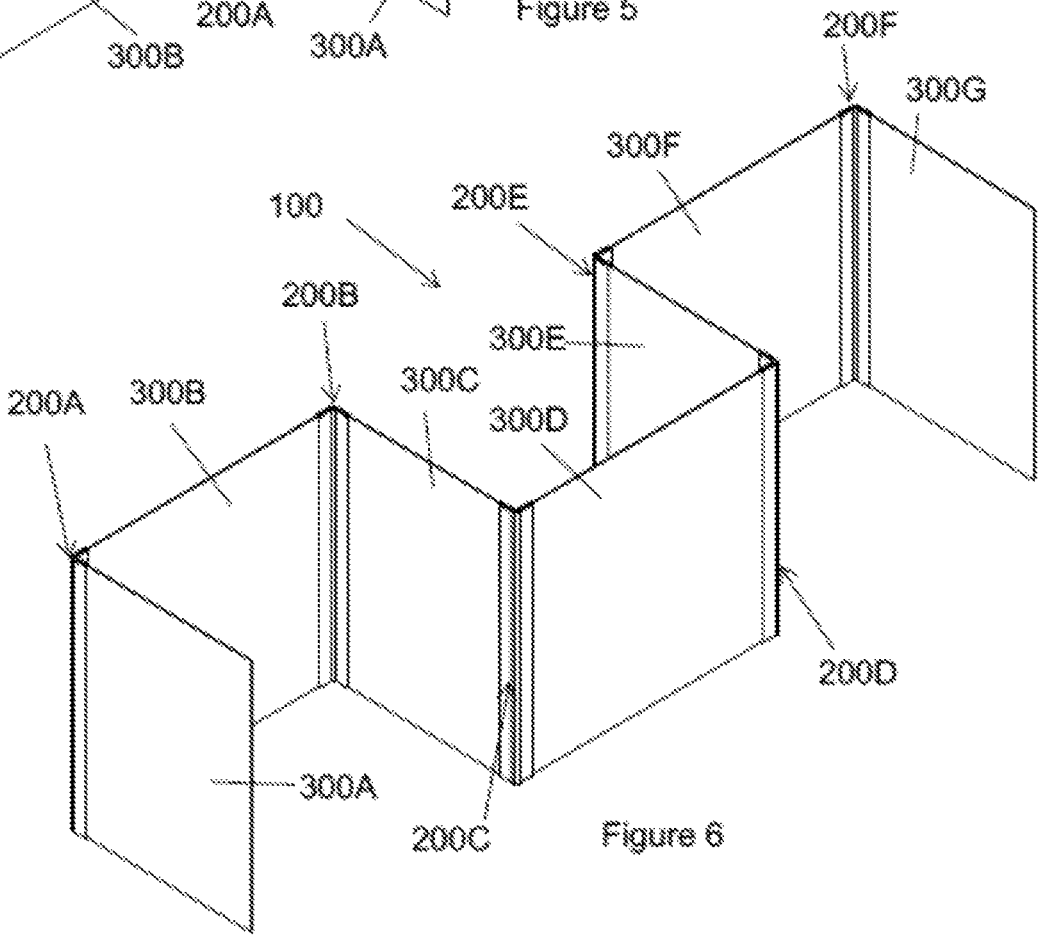
FIG. 6 is an illustrative view of the divider assembly in a fourth configuration.

The fourth configuration of the divider assembly 100 is shown in FIG. 6. It can be considered as an expansion of the first configuration in FIG. 3. There are six support structures 200A to 200F holding seven dividers 300A to 300G. All support structures 200A to 200F are not directly connected but are inter-connected by respective dividers 300B to F to from a crenulated structure that creates three sub-spaces arranged side by side. Each of these three sub-spaces are delimited in at least three sides.

Figure 7A:
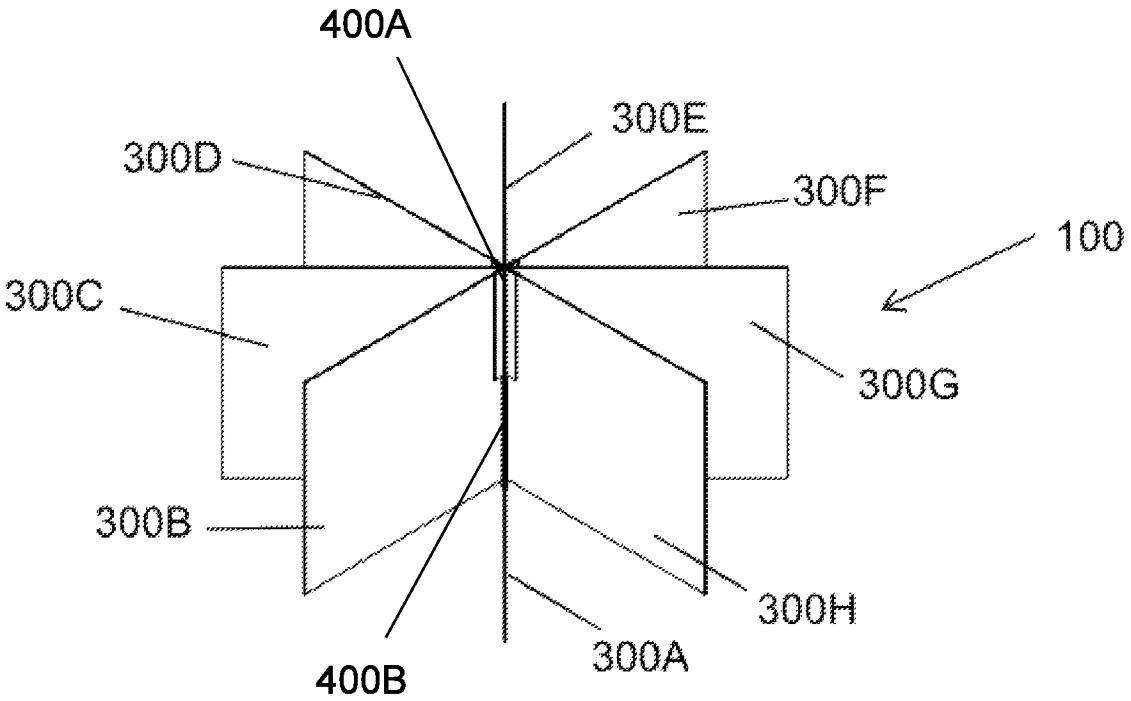
FIG. 7A is an illustrative view of the divider assembly in a fifth configuration.
Figure 7B:
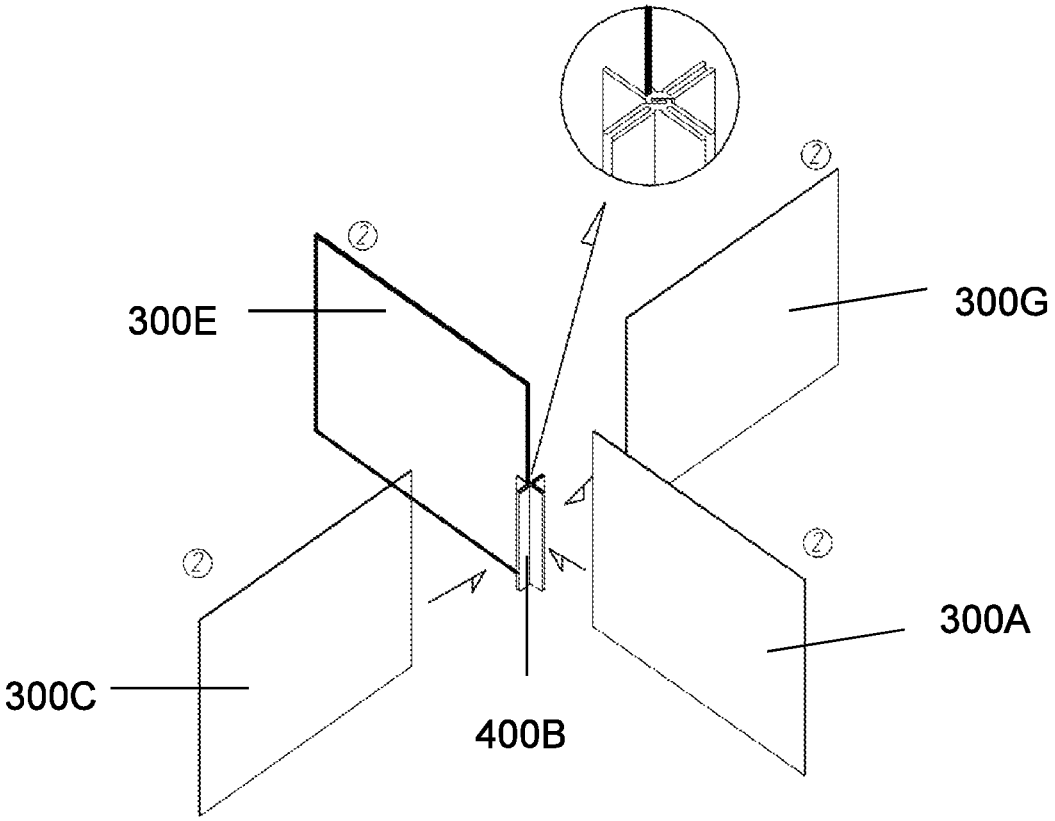
FIGS. 7B, 7C, 7D and 7E are illustrative sequential drawings showing the assembling of the fifth configuration in FIG. 7A.
Figure 7C:
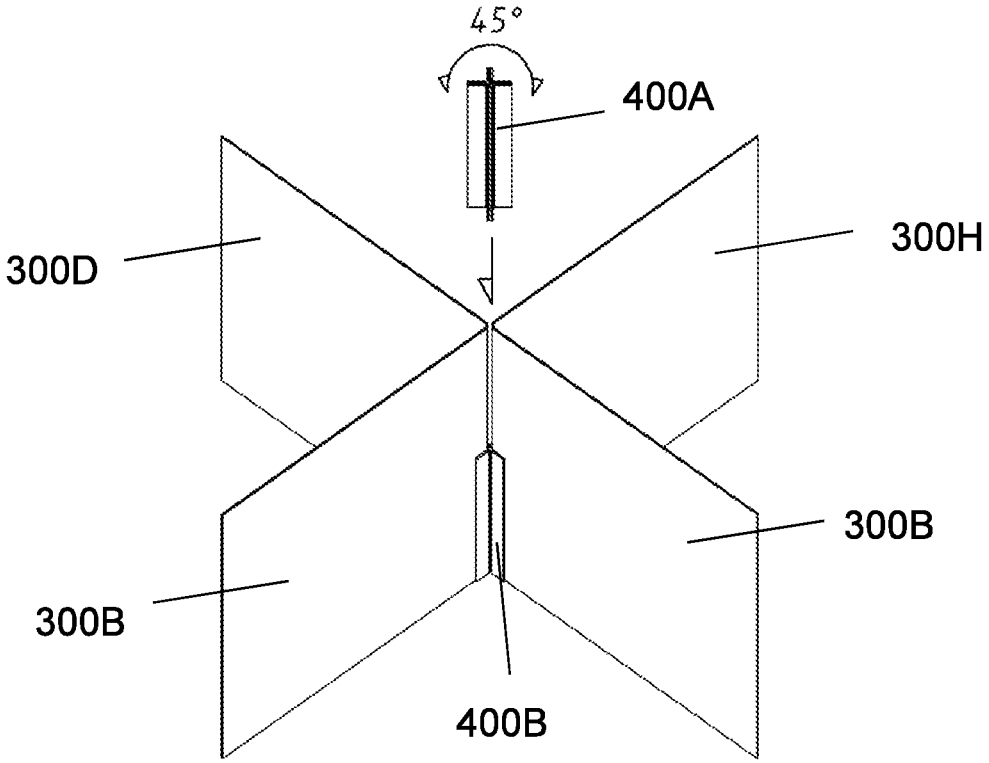
Figure 7E:
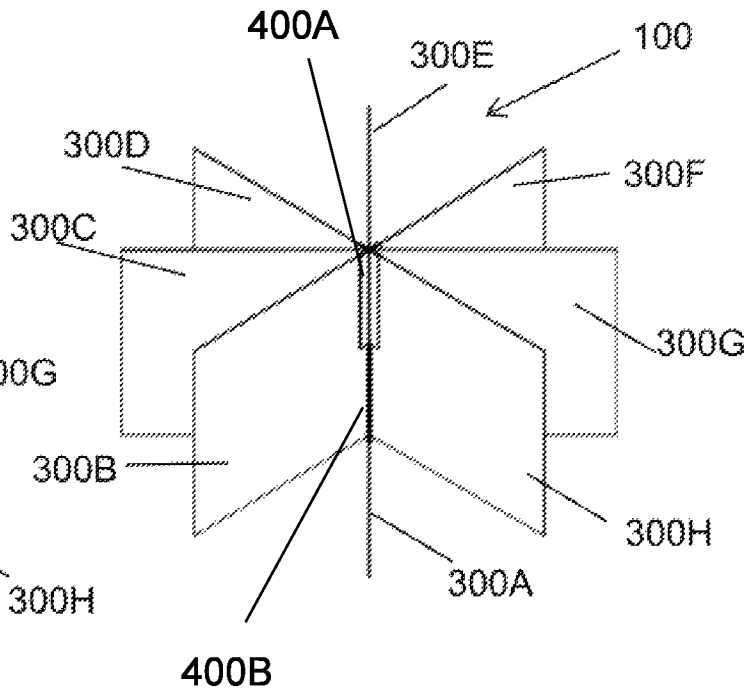
Figure 7D:
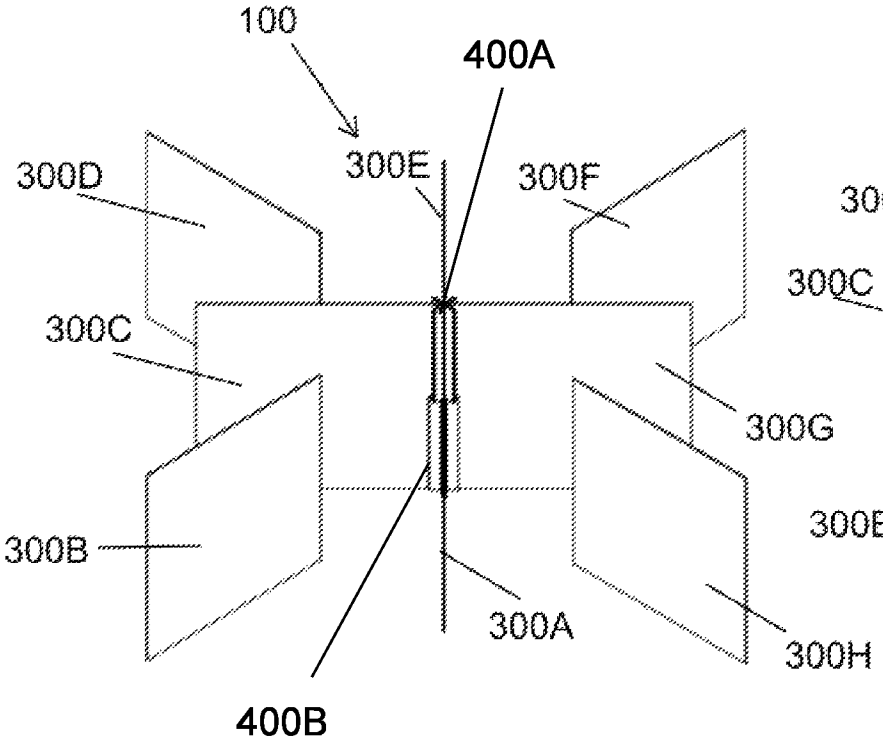

With reference to FIGS. 7A to 8, there is provided a more complex embodiment of the divider assembly 100. By making use of the auxiliary holders 207, this embodiment maximizes the use of four support structures 200A to 200D in creating eight sub-spaces with eight dividers 300A to 300H. More specifically, each pair of support structures 200A and 200B, 200C and 200D (first and second, third and fourth) are coupled to one another directly through the coupler 205 to form two support structure assemblies 400A and 400B. Divides 300A, 300C, 300E and 300E are inserted into respective holders 203 and 204 of the second support structure assembly 400B as shown in FIG. 7B. A first support structure assembly 400A is then placed on top of a second support structure 400B.

Figure 8B:
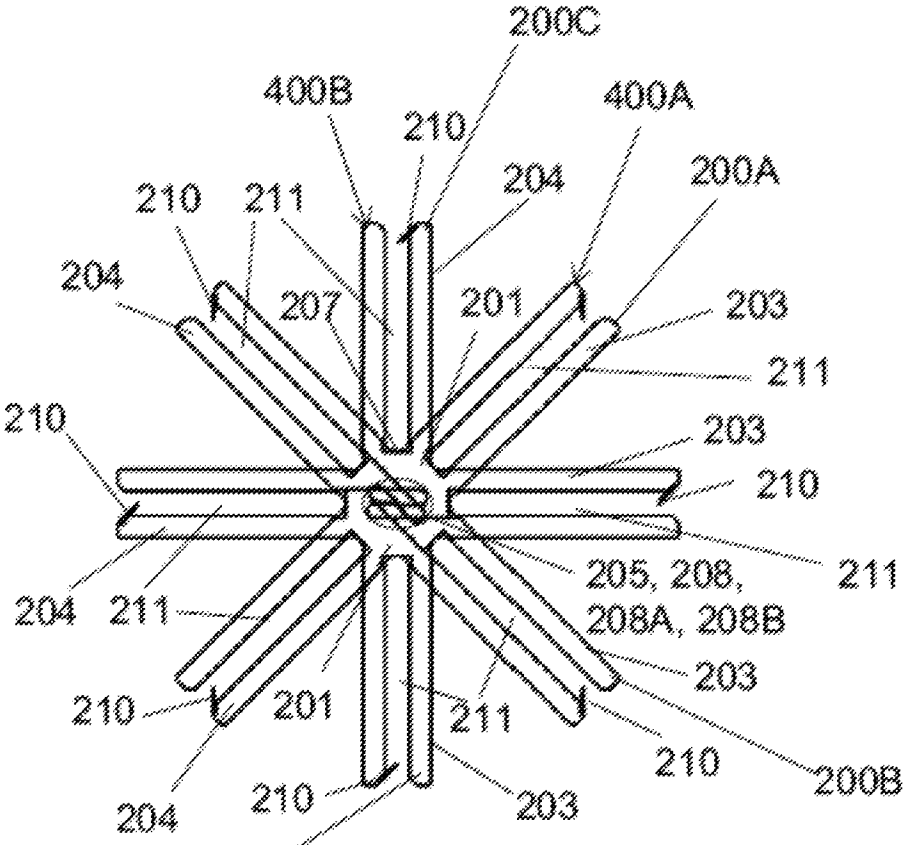
FIG. 8B is a top plan view of a second support structure assembly, in the fifth configuration as shown in FIGS. 7A to 7E, being placed on top of the first support structure assembly in FIG. 8A.
Figure 8A:
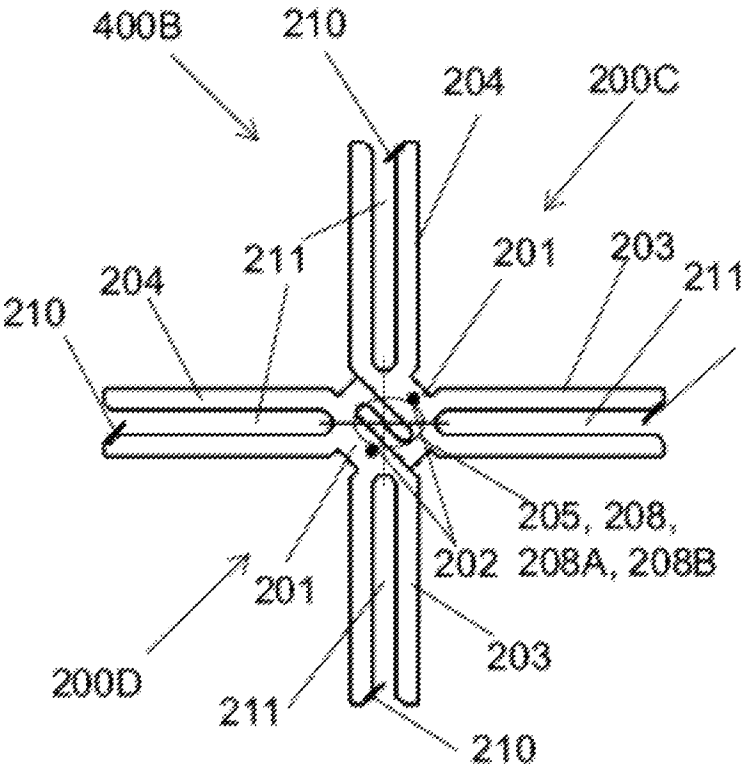
FIG. 8A is a top plan view of a first support structure assembly in the fifth configuration as shown in FIGS. 7A to 7E.

The first and second support structure assemblies 400A and 400B are in staggered arrangement such that when the auxiliary holder 207 between the first and second holders 203 and 204 of the first support structure 200A is aligned with the second holder 204 of the third support structure 200C, the auxiliary holder 207 between the first and second holders 203 and 204 of the second support structure 200B is aligned with the first holder 203 of the fourth support structure 200D. The further auxiliary holder 207 between the first holders 203 of the first and second support structures 200A and 200B is aligned with the first holder of the third support structure 200C. The further auxiliary holder 207 between the second holders 204 of the first and second support structures 200A and 200B is aligned with the second holder of the fourth support structure 200D. Similarly, the auxiliary holder 207 between the first and second holders 203 and 204 of the third support structure 200C is aligned with the first holder of the first support structure 200A. The auxiliary holder 207 between the first and second holders 203 and 204 of the fourth support structure 200D is aligned with the second holder of the second support structure 200B. The further auxiliary holder 207 between the first holders of the third and fourth support structures 200C and 200D is aligned with the first holder 203 of the second support structure 200B. The auxiliary holder 207 between second holders of the third and fourth support structures 200C and 200D is aligned with the second holder 204 of the first support structure 200A. Referring to FIGS. 7A to 7E, all of the eight dividers 300A to 300H span across a pair of auxiliary holder 207 and holder 203 or 204 of respective support structures 200A to 200D. This is best illustrated in FIGS. 8A and 8B. The overall support structure assembly in this embodiment has a "*" footprint.

Either the support structures in this assembly is half as short as those in the embodiments as shown in FIGS. 1 to 6 or the dividers 300 are proportionally larger (e.g. 4 times larger) than those in the embodiments as shown in FIGS. 1 to 6.

In each of these divider 300 assemblies, the connections of dividers 300 to holders 203, 204 as well as the couplings between the support structures 200 are intact to an extent that no gap is present between the dividers 300 or the support structures 200 that will permit transmission of material between sub-spaces therethrough.

Although in the provided embodiments, the holders 203, 204 and the coupler 205 extend outwardly from the body 201 of the support structure 200, in an alternative embodiment, the holder may be extending inwardly into the body 201. In a further alternative embodiment, the holders 203, 204 and the coupler 205 may be of identical structural configuration.

The support structure 200 and its relevant parts as well as the divider 300 may be of any dimension depending on needs.

The invention has been given by way of example only, and various other modifications of and/or alterations to the described embodiment or configuration may be made by persons skilled in the art without departing from the scope of the invention as specified in the appended claims.

The invention claimed is:

1. A divider assembly for dividing a space into physically separated sub-spaces, comprising:

a support structure for fixing a divider in an upstanding orientation thereby dividing said space in which said divider is placed, the support structure includes:

a body defining a main axis, the body includes first, second and third sides, the first and third sides extend at right angle to each other, a first holder integrally formed with the first side of the body and includes a first groove for holding a first divider in an upstanding orientation, a second holder integrally formed with the third side of the body and includes a second groove for holding a second divider in an upstanding orientation, the first and second grooves are arranged at right angle to one another, a coupler, integrally formed on the second side of the body and extending away from the first and second holders, for direct interconnection with another said support structure, and an auxiliary holder integrally formed with the body, the auxiliary holder is located between the first and third sides of the body and opposite to the second side of the body, the auxiliary holder extends into the body from the exterior of the body, the auxiliary holder is configured to provide a support in the body for a third divider that is then within the auxiliary holder, and the auxiliary holder is configured for holding the third divider in an upstanding orientation such that all of the dividers radiate from the body in respective directions away from the coupler.

2. The divider assembly as claimed in claim 1, wherein each of the first groove of the first holder and the second groove of the second holder is configured to hold, by friction, said first divider and said second divider in said upstanding orientation.

3. The divider assembly as claimed in claim 2, wherein each of the first and second holders includes a pair of lips that defines the first and second grooves for holding the first and second dividers.

4. The divider assembly as claimed in claim 1, wherein the holder includes a friction enhancement structure.

5. The divider assembly as claimed in claim 4, wherein the friction enhancement structure comprises a deformable tongue.

6. The divider assembly as claimed in claim 3, wherein each of the first and second holders of the support structure elongates lengthwise in a direction parallel to the main axis along an entire length of the body.

7. The divider assembly as claimed in claim 2, wherein the coupler of the support structure elongates lengthwise in a direction parallel to the main axis along an entire length of the body.

8. The divider assembly as claimed in claim 1, wherein the coupler of the support structure includes an abutment surface which is transversely oriented relative to the radial direction.

9. The divider as claimed in claim 8, wherein the coupler comprises an arm that extends from the body of the support structure, the arm includes the abutment surface for abutting an arm of said another support structure.

10. The divider as claimed in claim 9, wherein the abutment surface includes an auxiliary abutment surface that extends transversely to the abutment surface.

11. The divider assembly as claimed in claim 10, wherein the arm has an L-shaped configuration and is integrally formed with the body of the support structure.

12. The divider assembly as claimed in claim 1, wherein the first holder is at a right angle to the second holder.

13. The divider assembly as claimed in claim 1, wherein the coupler is provided opposite to the auxiliary holder.

14. The divider assembly as claimed in claim 1, further comprising the third divider supported in the auxiliary holder.

15. The divider assembly as claimed in claim 1, further comprising: the auxiliary holder comprises a recess formed in the body, wherein the recess in the body is shaped and configured for holding the third divider in the recess.

* * * * *